United States Patent [19]

Yoshida et al.

[11] Patent Number: 5,020,206

[45] Date of Patent: Jun. 4, 1991

[54] METHOD OF MANUFACTURING SLIDE FASTENER CHAIN BEARING PATTERNS

[75] Inventors: Hiroshi Yoshida; Sotoshi Saito; Tatsuo Ito, all of Kurobe, Japan

[73] Assignee: Yoshida Kogyo K. K., Tokyo, Japan

[21] Appl. No.: 569,981

[22] Filed: Aug. 20, 1990

[30] Foreign Application Priority Data

Aug. 23, 1989 [JP] Japan ..... 1-216831

[51] Int. Cl.[5] ..... B21D 53/50

[52] U.S. Cl. ..... 29/408; 29/707; 29/766

[58] Field of Search ..... 29/408, 410, 766, 767, 29/707, 33.2

[56] References Cited

U.S. PATENT DOCUMENTS 3,570,104 3/1971 Jensen ..... 29/766
4,625,375 12/1986 Osaki ..... 29/766
4,932,113 6/1990 Frohlich et al. ..... 29/766

FOREIGN PATENT DOCUMENTS 61-143578 9/1986 Japan .

*Primary Examiner*—P. W. Echols

*Attorney, Agent, or Firm*—Hill, Van Santen, Steadman & Simpson

[57] ABSTRACT

In manufacturing a slide fastener chain, (a) two series of alignment markers are applied to the continuous fastener tapes at intervals longitudinally thereof with their respective patterns matched with each other; (b) the opposed continuous fastener tapes are fed in side-by-side toward an element-attaching station; (c) the corresponding alignment markers are detected during the feed of the opposed continous fastener tapes; (d) the feeds of the opposed fastener tapes are controlled in such a way that the fastener tapes are allowed to continue feeding if the corresponding alignment markers prove to be in registry with each other, or the feed of the preceding fastener tape is restrained to thus bring the corresponding alignment markers into registry, if the corresponding alignment markers proves out of registry with each other; and (e) the two rows of continuous fastener elements are applied to the longitudinal edges of the opposed fastener tapes with the alignment markers in registry with each other, so that a slide fastener chain having the continouous fastener tapes bearing their respective patterns matched with each other is provided.

2 Claims, 8 Drawing Sheets

METHOD OF MANUFACTURING SLIDE FASTENER CHAIN BEARING PATTERNS

BACKGROUND OF THE INVENTION

1. Field of the Invention

The present invention generally relates to a method of manufacturing a slide fastener chain for use on ski wear, sports wear, other types of clothing, baggage etc. and particularly to a method of manufacturing a slide fastener chain having letters, marks or any other pattern for ornamental purposes.

2. Prior Art

If one desires to apply patterns or marks to slide fastener tapes, it is theoretically possible to print or dye desired patterns or marks on the slide fastener tapes of a finished slide fastener. However, this method is very difficult if not impossible because the finished slide fastener carries fastener element rows on its fastener tapes. In this circumstance, usually, desired patterns have been either woven into a continuous fastener tape such as by Dobby weave or Jacqard weave, during weaving thereof, or are printed or dyed on continuous fastener tapes before the fastener element rows are attached to the continuous fastener tapes.

However, this conventional method has suffered disadvantages. The patterns on the opposed continuous fastener tapes tend to be mismatched with each other. Such a mismatch of patterns is not conspicuous if the patterns are small. But, if they are large, the mismatch stands out and looks unsightly. Furthermore, if a pair of complementary halves of one letter are provided, one on each of the opposed fastener tapes, mismatch of the letter halves results in unreadable letters. One cause of the mismatch of the patterns proves to be intrinsic variance in stretchability of fabric fastener tapes. Another cause is the variance in the feeding speeds of opposed fastener tapes caused by various mechanical and physical factors. Since these causes are inevitable, it is considered to be very difficult if not impossible to provide the fastener chain with matching patterns disposed on respective opposed tapes.

SUMMARY OF THE INVENTION

With the foregoing difficulties in view, it is therefore an object of the present invention to provide a method of manufacturing a continuous slide fastener chain including a pair of continuous opposed fastener tapes having their respective patterns matched with each other.

According to the present invention, there is provided a method of manufacturing a slide fastener chain including a pair of continuous fastener tapes having their respective patterns matched with each other and two rows of continuous fastener elements mounted along the inner longitudinal edges thereof, the method comprising the steps of: (a) applying two series of alignment markers to the continuous fastener tapes at intervals longitudinally thereof with their respective patterns matched with each other; (b) feeding the opposed continuous fastener tapes in side-by-side relation toward an element-attaching station; (c) detecting the corresponding alignment markers during the feed of the opposed continuous fastener tapes; (d) controlling the feed of the opposed fastener tapes in such a way as to let the fastener tapes continue to feed if the corresponding alignment markers prove to be in registry with each other, and to restrain the feed of the preceding fastener tape to thus bring the corresponding alignment markers into registry, if the corresponding alignment markers prove to be out of registry with each other; and (e) attaching the two rows of continuous fastener elements to the inner longitudinal edges of the opposed fastener tapes at the element-attaching station, with the alignment markers in registry with each other.

Many other advantages and features of the present invention will become manifest to those versed in the art upon making reference to the detailed description and the accompanying drawings in which preferred structural embodiments incorporating the principles of the present invention are shown by way of illustrative example.

BRIEF DESCRIPTION OF THE DRAWINGS

FIG. 4(A) is a rearside view and FIG. 4(B) and 4(C) are front side views;

DETAILED DESCRIPTION

Figure 4A:
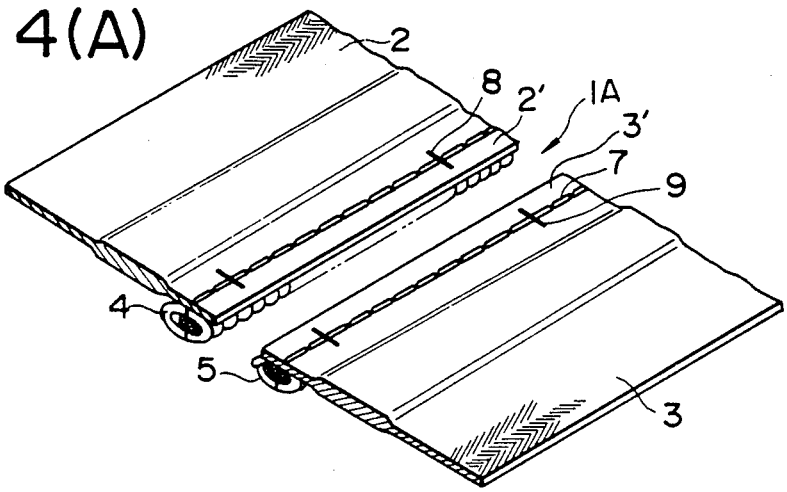
FIGS. 4(A), 4(B) and 4(C) are enlarged fragmentary perspective views of a slide fastener chain of the concealed type, showing sequential steps of coupling the slide fastener chain.
Figure 4B:
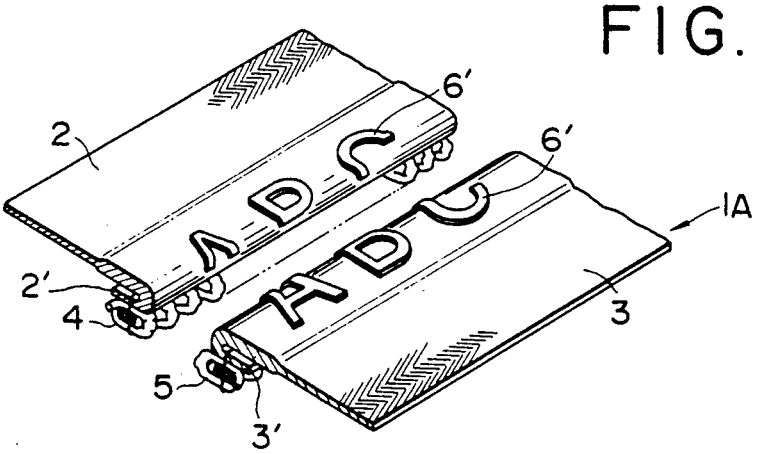
Figure 4C:
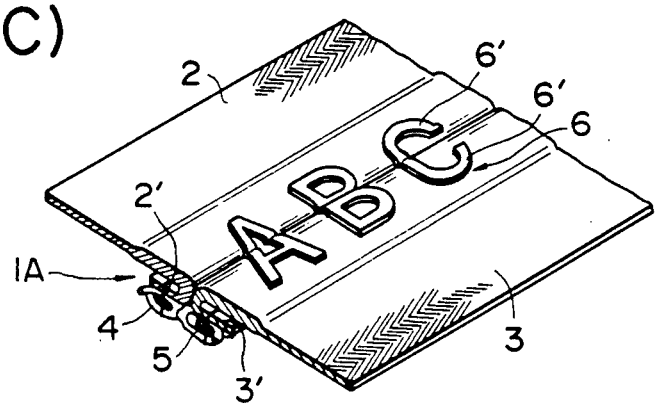

FIG. 4(C) shows a fragment of a concealed type slide fastener chain 1A manufactured in accordance with a method according to the present invention. The slide fastener chain 1A comprises a pair of continuous fastener tapes 2, 3 and two rows of interlocking fastener elements 4, 5 sewn to and along the respective folded longitudinal edges 2', 3' thereof. As better shown in FIG. 4(B), the opposed fastener tapes 2, 3 bear two complementary pattern halves 6', 6', respectively, which provide a single complete pattern 6 when the slide fastener chain 1A is closed, as shown in FIG. 4(C). As shown in FIG. 4(A), when manufacturing the slide fastener chain 1A, the fastener tapes 2, 3 having the complementary pattern halves (not seen) on their respective front surface are fed in side-by-side with their front surfaces directed downwards; two rows of plastic coiled fastener elements 4, 5 are sewn to the downwards-directed front surfaces along the inner longitudinal marginal edges 2', 3' of the fastener tapes 2, 3; then, the element-carrying edges 2', 3' originally directed downwards are folded upwards above the front surfaces of the fastener tapes 2, 3, resulting in a configuration and orientation similar to that shown in FIG. 4(C) but upside down.

The desired pattern 6 may be woven into the fastener tapes 2, 3, as the fastener tapes 2, 3 are woven, with Dobby machines or Jacquard machines. Alternatively, after the fastener tapes 2, 3 have been woven or knitted, they may be provided with the desired pattern 6 through printing or dying.

Figure 1:
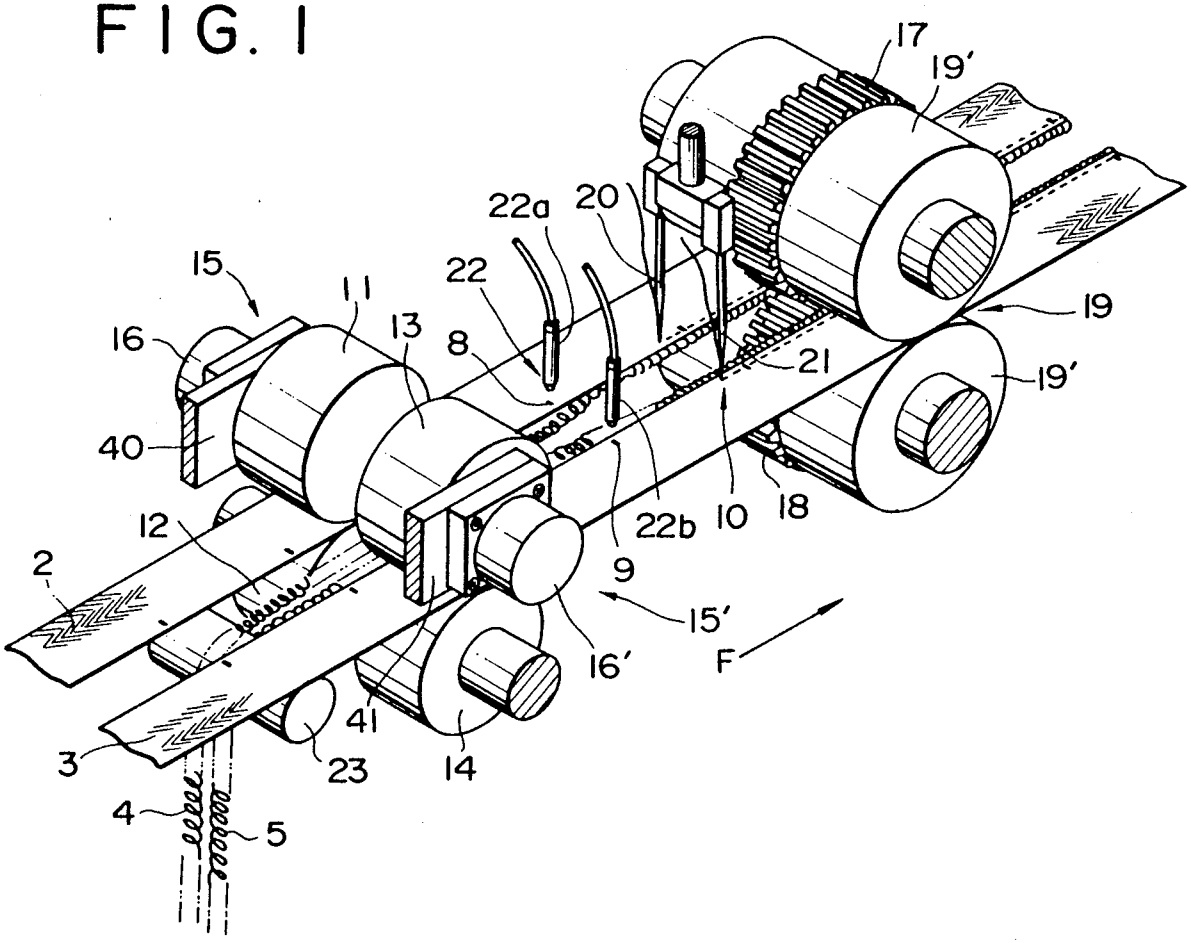
FIG. 1 is a fragmentary perspective view of an apparatus which is used to practice a method according to the present invention.

FIG. 1 shows an apparatus which is used to practice the method according to the present invention in order to manufacture the slide fastener chain 1A shown in FIG. 4(A).

As better shown in FIG. 4(A), a pair series of alignment markers 8, 9 are applied to the respective fastener tapes 2, 3 on their rear surfaces. The alignment markers 8, 9 may be applied to the fastener tapes 2, 3 after the patterns 6 have been provided thereon, but most preferably the alignment markers 8, 9 are applied thereto concurrently as the patterns 6 are provided thereon. In any event, the alignment markers 8, 9 must be applied at intervals longitudinally to the respective slide fastener tapes 2, 3 with the pattern halves 6', 6' matched with each other exactly. Furthermore, it is the most preferable to apply the alignment markers 8, 9 along the confronting inner longitudinal edge 2', 3', of the slide fastener chain 2, 3 as shown in FIG. 4(A). This is because, as the fastener element rows 4, 5 are sewn to the longitudinal edges 2', 3' with stitches 7, the opposed longitudinal edges 2', 3' are inclined to contract independently from each other due to the stitching, thereby bringing the alignment markers 8, 9 out of registry with each other.

Figure 2:
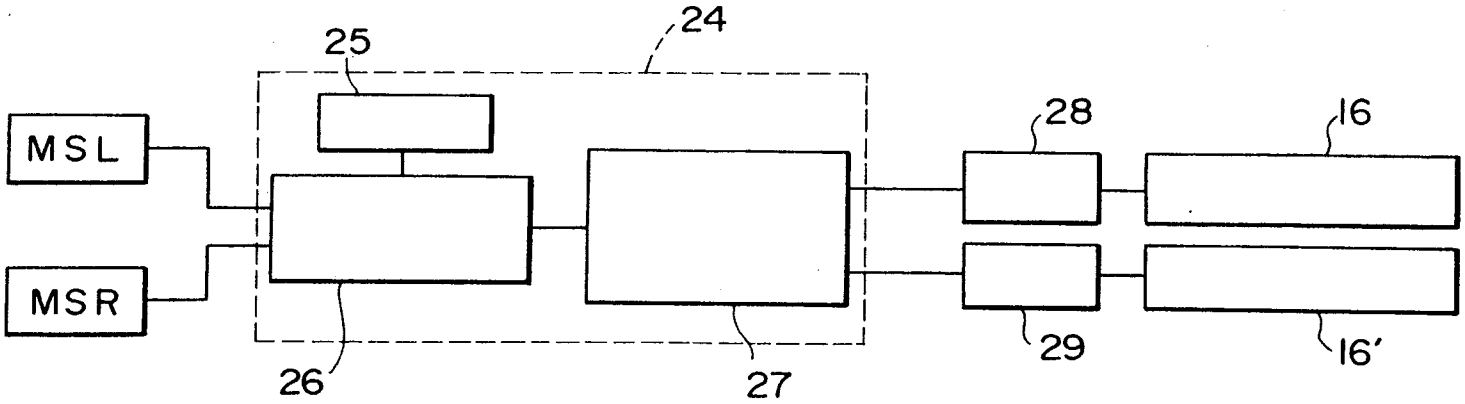
FIG. 2 is a block diagram of a control means incorporated in the apparatus of FIG. 1.

FIG. 1 shows part of an apparatus to be used to practice the present invention. As shown in FIG. 1, the continuous fastener tapes 2, 3 are fed intermittently on a horizontal path in juxtaposed relation with each other in a direction indicated by arrow F, with the surfaces bearing the alignment markers 8, 9 directed upwards. From upstream to downstream, the apparatus broadly comprises a guide roller 23, a pair of restraining means 15, 15', detecting means 22 comprising a pair of right and left photosensors 22*a*, 22*b*, an element-attaching station 10 and feeding means 19. The restraining means 15, 15' each comprises a pair of upper and lower brake rollers 11, 12; 13, 14 disposed perpendicularly to the horizontal path and an electromagnetic brake 16; 16' disposed by the outer side of the upper roller 11, 13. Each pair of upper and lower brake rollers 11, 12; 13, 14 are normally urged toward each other to predetermined extent to hold the continuous fastener tapes 2, 3 under tension therebetween. The electromagnetic brake 16, 16' are mounted on the respective brackets 40, 41 connected to a base frame (not shown) of the apparatus and are adapted to brake the upper rollers 11, 13 through value of voltage controlled as shown in FIG. 2 so as to restrain the feed of the slide fastener tapes 2, 3. Alternatively, the electromagnetic brakes 16, 16' may be mounted by the outer sides of the lower brake rollers 12 and 14. The restraining means 15, 15' are thus adapted to adjust the feeding amounts of the right and left fastener tapes 2, 3 independently from each other.

Figure 3:
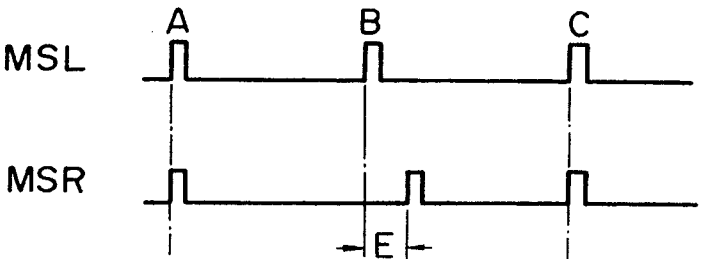
FIG. 3 is a time chart showing an example of output signals generated when a corresponding pair of left and right alignment markers are detected.

The braking forces imparted to the right and left brake rollers 11, 12; 13, 14 are adjusted as shown in FIGS. 2 and 3; that is, as soon as the left and right sensors 22*a*, 22*b* detect the alignment markers 8, 9, the sensors 22*a*, 22*b* generate pulse signals MSL, MSR, respectively. The pulse signals MSL, MSR are input into a main control unit 24. The main control unit 24 comprises a comparator circuit 26 equipped with a timer 25 and an operation circuit 27 which is activated by the pulse signals MSL and MSR. The outputs of the operation circuit 27 are input into the operation amplifiers 28, 29. The braking forces of the electromagnetic brakes 16, 16' are adjusted by the outputs of the operation amplifiers 28, 29.

FIG. 3 shows a time chart of the pulse signals MSL, MSR generated by the sensors 22*a*, 22*b* when they detect the alignment markers 8, 9. If the pulse signals MSL, MSR generated by the sensors 22*a*, 22*b* are input into the main control unit 24 concurrently, the main control unit 24 is not activated. On the contrary, if, as indicated by point B in FIG. 3, the pulse signals MSR is delayed relative to the pulse signal MSL by a lag E, the timer 25 is activated by the preceding pulse signal MSL and the timer 25 is stopped by the ensuing pulse signal MSR. The lag E is converted into delay time by the comparator circuit 26. A pulse signal having a duration equivalent to the delay time output from the comparator 26 is input into the operation circuit 27. Then, the operation circuit 27 converts the lag E into a voltage. In order to rectify the delay of the fastener tape 2 corresponding to lag E, the voltage from the operation amplifier 28 controls the electromagnetic brake 16 for the fastener tape 2 whose alignment marker 8 was detected earlier.

The braking-force-control is effected such that, when the alignment markers 8, 9 come out of registry with each other, the braking force is imparted to the brake rollers 11, 12; 13, 14. Since the braking force may be imparted too acutely, the fastener tapes 2, 3 are subjected to severe tension so that the fastener tapes 2, 3 are inclined to stretch detrimentally. Therefore, the outputs into the electromagnetic brakes 16, 16' should not be applied suddenly but in gradual ascent to a target value. To this end, the operation circuit 27 holds a fuzzy control circuit (not shown) in which various control algorithm are expressed in if-then-form. Through the fuzzy control circuit, the restraining forces are imparted to the fastener tapes 2, 3 gradually. Furthermore, when the fastener tapes 2, 3 are subjected to unexpected stresses, the fuzzy control circuit can advantageously control the stresses.

In FIG. 1, the element-attaching station 10 comprises a machine body (not shown) disposed above the horizontal path and a pair of needles 20, 21 mounted thereon so as to vertically reciprocate in and out of the fastener tapes 2, 3 for sewing the two rows of fastener elements 4, 5 along the inner longitudinal edges 2', 3' of the fastener tapes 2, 3. While the needles 20, 21 descend to effect stitches 7, the opposed fastener tapes 2, 3 halt; while the needles 20, 21 ascend out of the fastener tapes 2, 3, the fastener tapes 2, 3 are fed subtly, and thereby intermittently.

The guide roller 23 is disposed a little ahead of the brake rollers 11, 12; 13, 14 so as to guide the two rows of fastener elements 4, 5 therearound, then between the lower brake rollers 12, 14 to the fastener attaching station 10.

The feeding means 19 comprises a pair of upper and lower feeding rollers 19' and 19' which are disposed vertically to the horizontal path so as to hold the fastener tapes 2, 3 therebetween. The feeding rollers 19', 19′ have axially in their middles respective peripheral driving gears 17, 18. These peripheral driving gears 17, 18 are intermeshed with each other so as rotate in opposite directions to feed the fastener tapes 2, 3 between the feeding rollers 19′, 19′.

Figure 7:
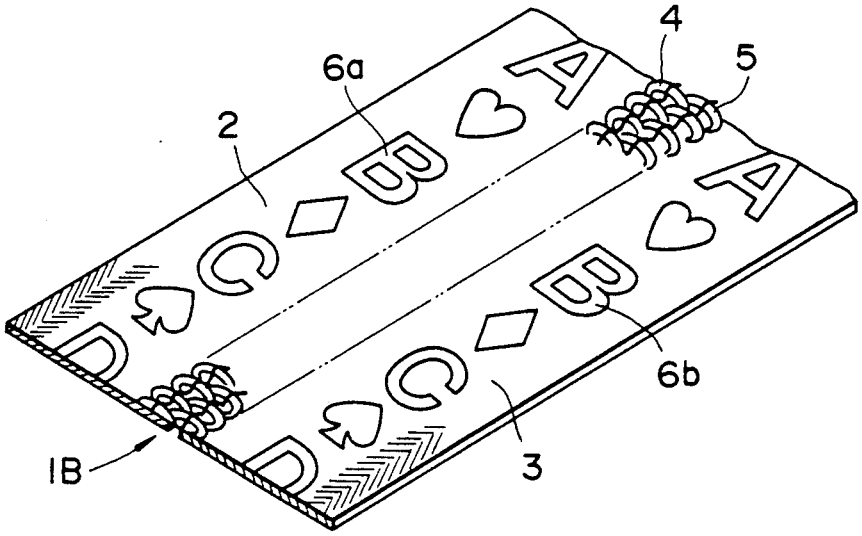
FIG. 7 is a view similar to FIG. 4(C) but shows another example of a continuous slide fastener chain other than the one shown in FIGS. 4(A), 4(B) and 4(C)

FIG. 7 shows a slide fastener chain 1B comprising a pair of fastener tapes 2, 3 having on their respective front surfaces independent patterns **6*a* and 6*b* which are symmetrical to each other relative to the coupled element rows 4, 5. This slide fastener chain 1B may be manufactured with the apparatus shown in FIG. 1**.

Figure 5:
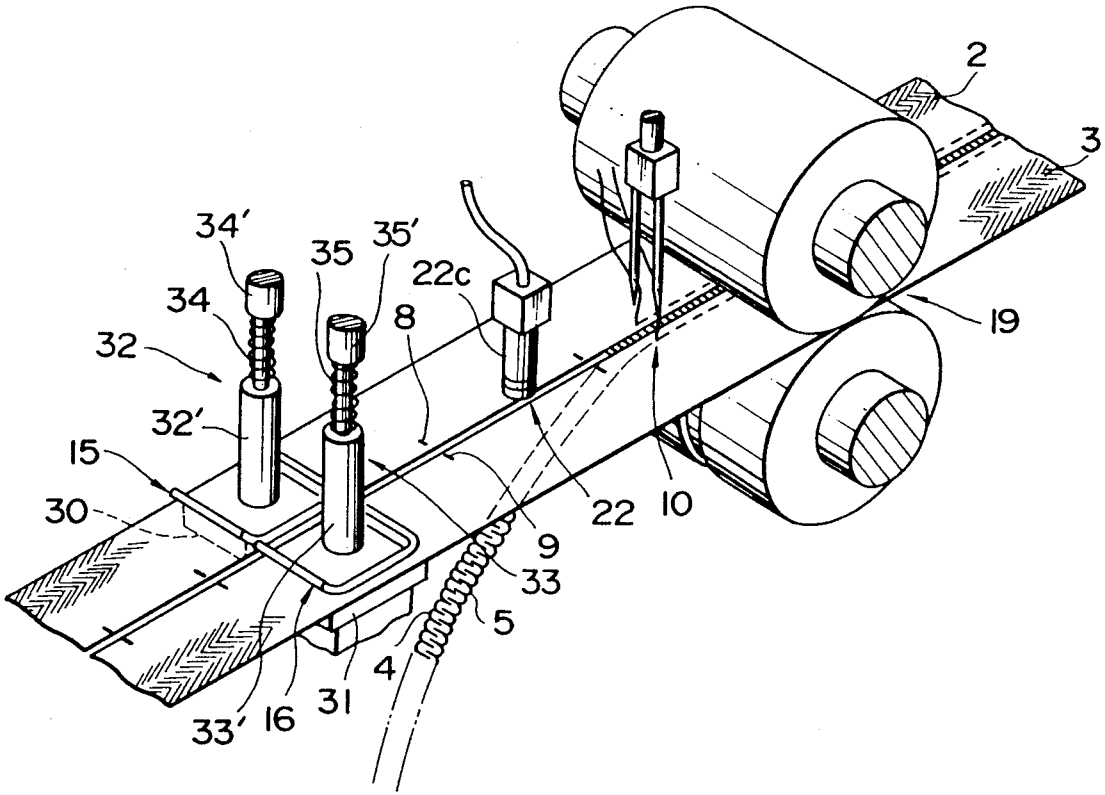
FIG. 5 is a view similar to FIG. 1 but shows an apparatus according to another embodiment of the present invention.
Figure 6:
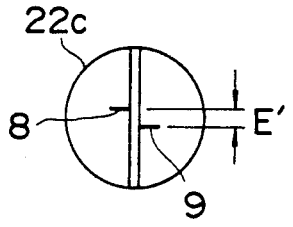
FIG. 6 shows how an image sensor detects the corresponding pair of left and right alignment markers.

As seen in FIG. 5, two series of alignment markers 8, 9 are attached at intervals along the confronting inner longitudinal edges 2′, 3′ and on the rear surfaces of the fastener tapes 2, 3 in such a manner that the two series of alignment markers 8, 9 are disposed in registry with each other with the patterns **6*a*, 6*b* on the front surface matched with each other. In this embodiment, instead of the two photosensors 22*a*, 22*b*, a single image sensor 22*c* is used as a detecting means to detect the two alignment markers 8, 9 on both fastener tapes 2, 3 as a whole. FIG. 6 shows how the image sensor 22*c* detects a lag E′ between the alignment markers 8, 9 on the opposed fastener tapes 2, 3. In this embodiment, alternatively, two photosensors may be used, one for each slide fastener. Furthermore, in this embodiment, instead of the two pairs of rollers 11, 12; 13, 14, a pair of presser feet 32, 33 and corresponding ground plates 30, 31 are employed as restraining means 15, 15′ to restrain the slide fasteners 2, 3. Each presser foot 32, 33 comprises a base rod 34′, 35′, a presser foot proper 32′, 33′ reciprocative axially of the base rod 34′ 35′ and a compression spring 34, 35 acting between the base rod 34′, 35′ and the presser foot proper 32′, 33′ so as to urge the presser foot proper 32′, 33′ downwards. Consequently, the presser foot propers 32′, 33′ press the slide fastener tapes 2, 3 against the ground plates 30, 31, respectively, to thereby restrain the fastener tapes 2, 3**.

Figure 8:
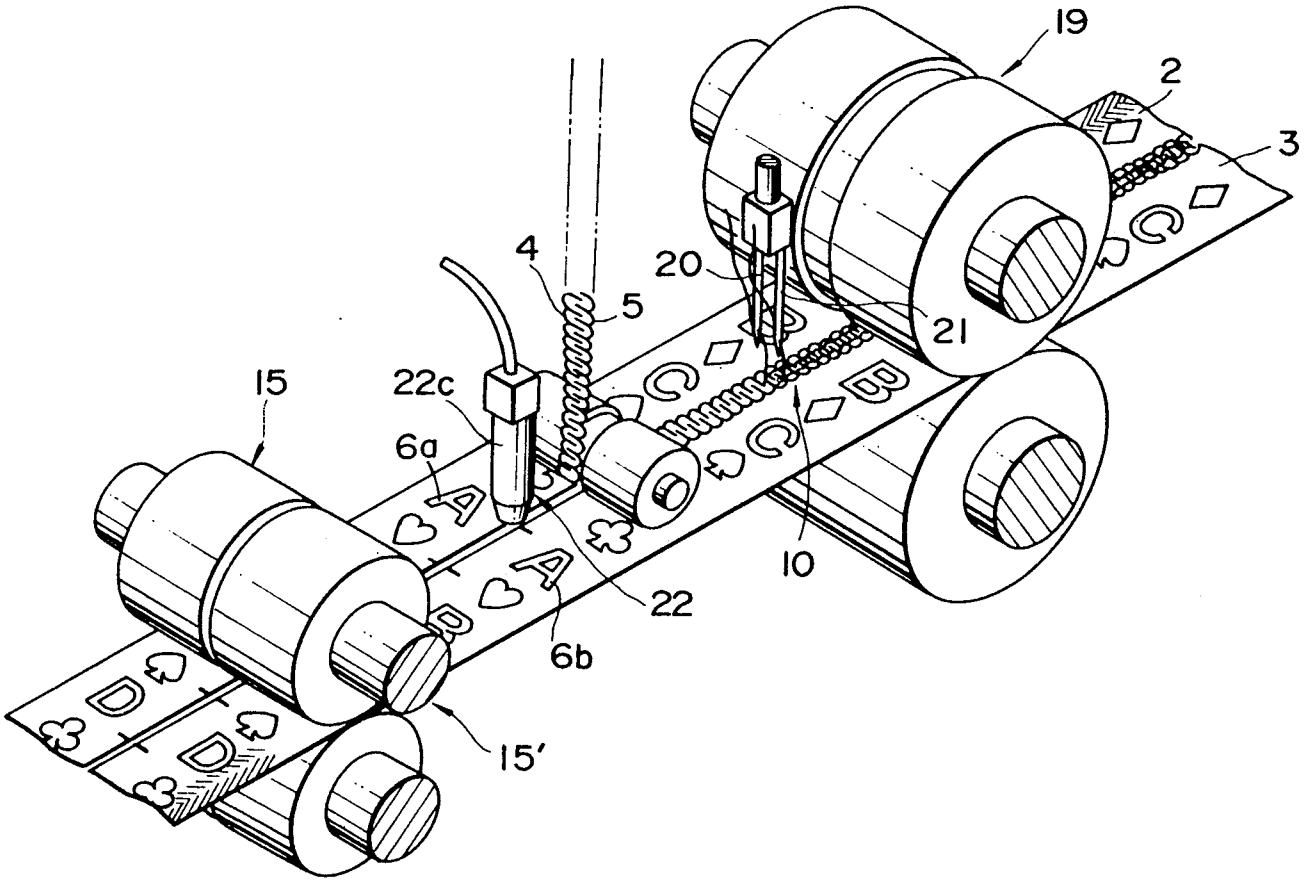
FIG. 8 is a view similar to FIG. 1 but shows an apparatus according to still another embodiment of the present invention.

FIG. 8 shows still another embodiment of the present invention. Unlike the preceding embodiments, the fastener tapes 2, 3 are fed on the horizontal path with the surfaces bearing patterns **6*a*, 6*b* directed upwards. Two series of alignment markers 8, 9 are applied at intervals along the respective confronting inner longitudinal edges 2, 3 of the fastener tapes 2, 3, such that the alignment markers 8, 9 on the fastener tapes 2, 3 are disposed in registry with each other with the patterns 6*a*, 6*b* on the fastener tapes 2, 3 matched with each other. Unlike the preceding embodiments, the fastener elements rows 4, 5** are fed downwards.

Figure 9:
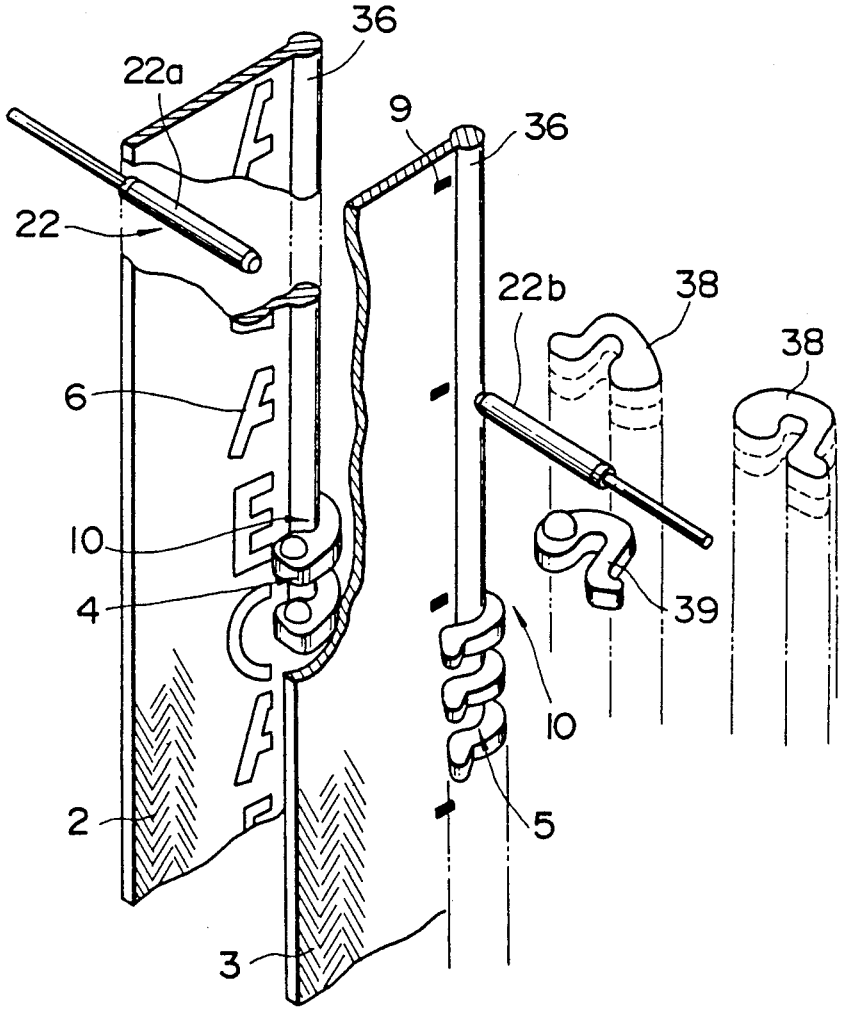
FIG. 9 is a fragmentary perspective view of an apparatus according to still another embodiment of the present invention.
Figure 10:
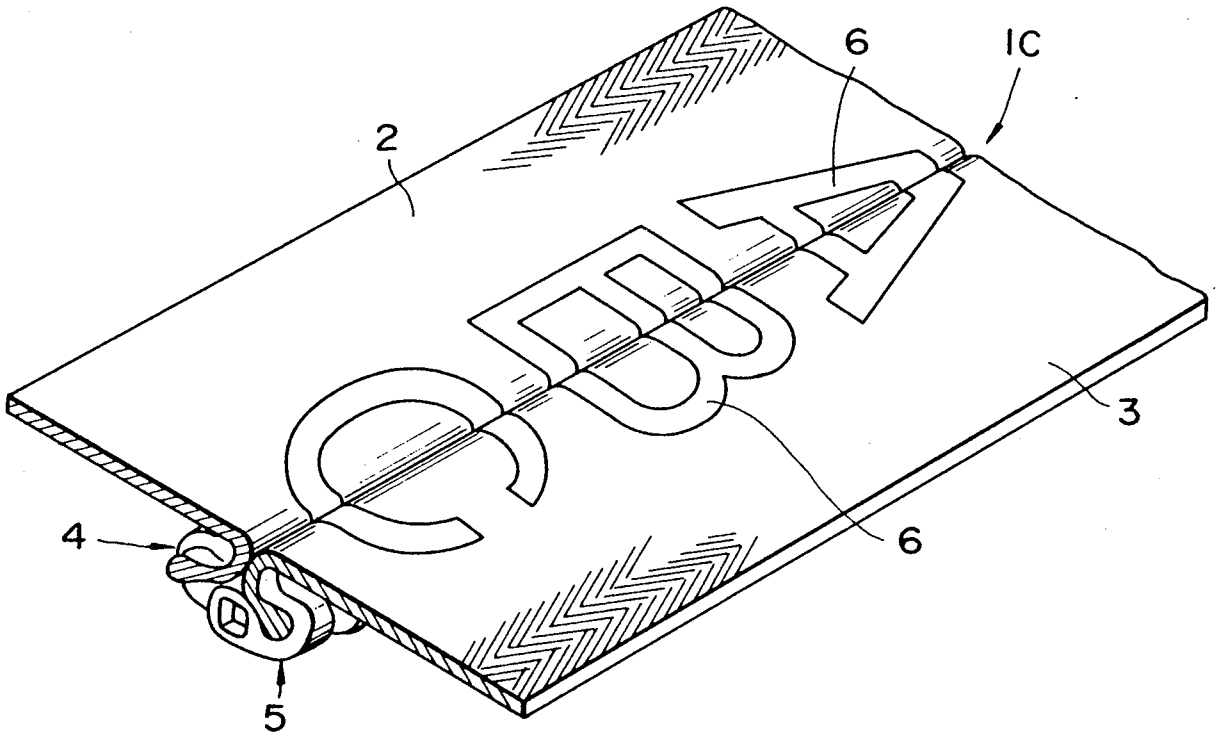
FIG. 10 is an enlarged fragmentary perspective view of a continuous slide fastener chain manufactured with the apparatus shown in FIG. 9.

A slide fastener chain 1C shown in FIG. 10 is manufactured in the following way. As shown in FIG. 9, a continuous metal wire 38 whose cross-section is substantially U-shape is sliced into individual metal elements 39. Then, the thus-formed elements 38, 38 are clamped to the beaded edge 36 provided along the inner longitudinal edge 2′, 3′ of the fastener tapes 2, 3. Thereafter, the beaded edge 36 is folded flat over the rear surface of the fastener tape 2, 3, so that a concealed type slide fastener chain 1C is provided as shown in FIG. 10. A the respective front surfaces of the opposed fastener tapes 2, 3. As shown in FIG. 9, a pair of fastener tapes 2, 3 are fed downwards perpendicularly with their front surfaces opposed to each other. A pair of photosensors **22*a*, 22*b* are disposed in opposed relation to each other, with the two fastener tapes 2, 3 fed therebetween. A series of alignment markers 9 (the other series omitted for brevity) are provided on the rear surface and adjacent to the beaded edges 36, 36 of the fastener tapes 2, 3**.

With the method according to the present invention set forth hereinabove, the following advantages are obtained.

Since the two fastener tapes are fed in such a controlled manner that the respective series of alignment markers on the fastener tapes are disposed in registry with each other at all times, patterns provided on the fastener tapes are completely exempt from mismatching.

Furthermore, if alignment markers are provided along the inner longitudinal edge of a fastener tape, which is the most susceptible to mechanically and physically caused mismatching of patterns, the preciseness of matching patterns on the opposed fastener tapes will be enhanced.

Obviously, various modifications and variations of the present invention are possible in light of the above teaching. It is therefore to be understood that within the scope of the appended claims the invention may be practiced otherwise than as specifically described.

What is claimed is:

1. A method of manufacturing a slide fastener chain including a pair of continuous fastener tapes having their respective patterns matched with each other and two rows of continuous fastener elements mounted along the inner longitudinal edges thereof, the method comprising the steps of:

(a) applying two series of alignment markers to the continuous fastener tapes at intervals longitudinally thereof with the respective patterns of the continuous fastener tapes matched with each other;

(b) feeding the opposed continuous fastener tapes in side-by-side toward an element-attaching station;

(c) detecting the corresponding alignment markers during the feed of the opposed continuous fastener tapes;

(d) controlling the feed of the opposed fastener tapes in such a way as to let the fastener tapes continue to feed if the corresponding alignment markers prove to be in registry with each other, and to restrain the feed of the preceding fastener tape to thus bring the corresponding alignment markers into registry, if the corresponding alignment markers prove to be out of registry with each other; and (e) attaching the two rows- of continuous fastener elements to the inner longitudinal edges of the opposed fastener tapes at the element-attaching station, with the alignment markers in registry with each other.

2. A method according to claim 1, the two series of alignment markers being applied to the respective inner longitudinal edges of the continuous fastener tapes.

* * * * *